US007766685B2

(12) United States Patent
Pabst et al.

(10) Patent No.: US 7,766,685 B2
(45) Date of Patent: Aug. 3, 2010

(54) PLUG CONNECTOR ARRANGEMENT WITH SECONDARY LOCKING

(75) Inventors: Thomas Bernhard Pabst, Herzogenaurach (DE); Hans-Otto Geltsch, Berg-Sindlbach (DE); Olaf Hoernlein, Erlangen (DE); Harald Pankau, Fuerth (DE)

(73) Assignee: FCI, Versailles (FR)

( * ) Notice: Subject to any disclaimer, the term of this patent is extended or adjusted under 35 U.S.C. 154(b) by 103 days.

(21) Appl. No.: 11/667,758

(22) PCT Filed: Nov. 15, 2005

(86) PCT No.: PCT/EP2005/012242

§ 371 (c)(1),
(2), (4) Date: Jan. 7, 2008

(87) PCT Pub. No.: WO2006/053717

PCT Pub. Date: May 26, 2006

(65) Prior Publication Data

US 2008/0268694 A1 Oct. 30, 2008

(30) Foreign Application Priority Data

Nov. 16, 2004 (DE) ..... 10 2004 055 297

(51) Int. Cl.
*H01R 13/627* (2006.01)

(52) U.S. Cl. ..... 439/352; 439/371

(58) Field of Classification Search ..... 439/352, 439/350, 349, 353, 357, 358, 371
See application file for complete search history.

(56) References Cited

U.S. PATENT DOCUMENTS

| | | | | |
|---|---|---|---|---|
| 5,120,255 | A * | 6/1992 | Kouda et al. | 439/489 |
| 6,077,101 | A | 6/2000 | Garretson et al. | 439/352 |
| 6,270,368 | B1 | 8/2001 | Duval | 439/211 |
| 6,343,948 | B1 * | 2/2002 | Nutzel | 439/358 |
| 6,402,540 | B1 | 6/2002 | Kuhmel et al. | 439/378 |
| 6,435,895 | B1 | 8/2002 | Fink et al. | 439/352 |
| 6,491,542 | B1 | 12/2002 | Zerebilov | 439/489 |
| 6,579,118 | B2 | 6/2003 | Endo | 439/489 |
| 6,609,029 | B1 * | 8/2003 | Mann et al. | 607/37 |
| 2003/0077939 | A1 | 4/2003 | Fukuda | 439/587 |

FOREIGN PATENT DOCUMENTS

| | | |
|---|---|---|
| DE | 100 05 858 A1 | 8/2001 |
| DE | 19939407 C2 | 1/2002 |
| DE | 101 51 956 A1 | 7/2002 |
| DE | 10247815 A1 | 5/2003 |
| DE | 102 24 757 B3 | 1/2004 |
| EP | 0 655 807 A2 | 11/1994 |
| EP | 0 788 193 A2 | 8/1997 |
| EP | 1 225 659 A2 | 7/2002 |
| EP | 1 369 965 A2 | 12/2003 |

* cited by examiner

*Primary Examiner*—Tho D Ta
*Assistant Examiner*—Travis Chambers
(74) *Attorney, Agent, or Firm*—Harrington & Smith

(57) ABSTRACT

The present invention relates to a plug connector arrangement with a plug, having first catch arms arranged parallel to the plug-in direction and a secondary locking, as well as a mating plug with shoulders, behind which catch lugs engage in a final plugged-in position on the first catch arms. The secondary locking is released from a pre-catch position by the mating plug during the plug-in process and, on reaching its final catch position, is held back by the first catch arms until the catch lugs thereof are locked behind the shoulders of the mating plug.

18 Claims, 12 Drawing Sheets

PLUG CONNECTOR ARRANGEMENT WITH SECONDARY LOCKING

Figure 1:
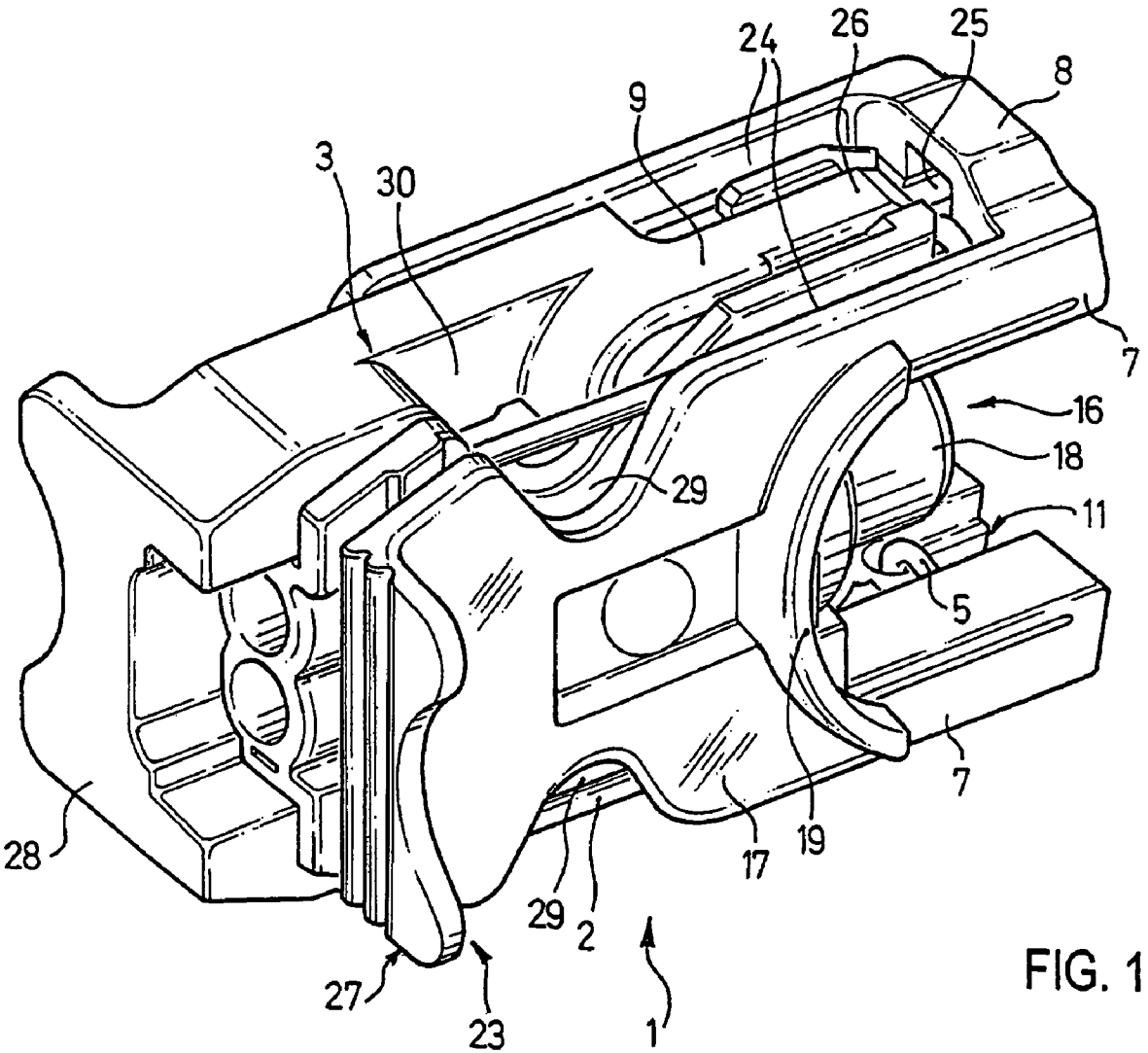

The present invention relates to a plug connector arrangement with secondary locking in accordance with the preamble of patent claim 1. Such a plug connector arrangement is known from DE 698 18 788 B1. Such plug connector arrangements are used, in particular, in automobile manufacture, for example, in cable wiring of an injector nozzle.

Such plug connector arrangements are used in the engine compartment of a motor vehicle, where they are exposed to raw external influences. These influences include temperature differences, vibrations, moisture, and dirt. This necessitates design measures so as to keep a plug connection functioning reliably. Included here is preventing the contact from coming loose due to vibrations and/or temperature fluctuations and preventing moisture and dirt from penetrating into the plug connector arrangement, so as to prevent corrosion of contacts.

Known from DE 698 18 788 is a plug connector arrangement in which a plug is plugged onto a cylindrical part at an angle of 90° to the cylinder axis. The cylindrical part involves an injector nozzle for diesel engines. The plug has locking arms that are made of bent steel wire and have catch lugs that engage behind shoulders that are formed on the cylindrical jacket of the injection nozzle. The catch arm exercises a very tight holding effect, because the catch arms, formed from steel wire, can have a high spring force. The loosening of the plug connection is accomplished relatively simply, because, in the part of the plug connected to the cables, the steel wires are pressed together, that is, are pressed toward each other, so that a "see-saw effect" ensues due to an underpropping of the wire catch arms in their middle region, so that the catch lugs are released from the locked position.

A drawback of this plug connector arrangement is that it is not possible to exclude an incomplete locking of the catch arms and also an unintentional release of the plug connection is possible, for example, by a backward pull on the connector cable.

The invention is based on the problem of presenting a plug connector arrangement for which an incomplete plugging together is ruled out and an unintended release of the plug connection is made impossible.

This problem is solved in accordance with the claim.

Features of preferred embodiments of the present invention are characterized in the subclaims.

The invention proceeds from the basic idea of creating a design in which it is impossible for an incompletely performed plugging operation to bring the secondary locking into its final position and for which it is visible, through the persistence of the secondary locking in its pre-catch position, that the plug and its own plug are plugged together.

The plug arrangement in accordance with the invention is suitable, in particular, for the cable wiring of an essentially cylindrical diesel injection nozzle, onto the axis of which the plug is plugged at an angle of 90°.

Figure 2:
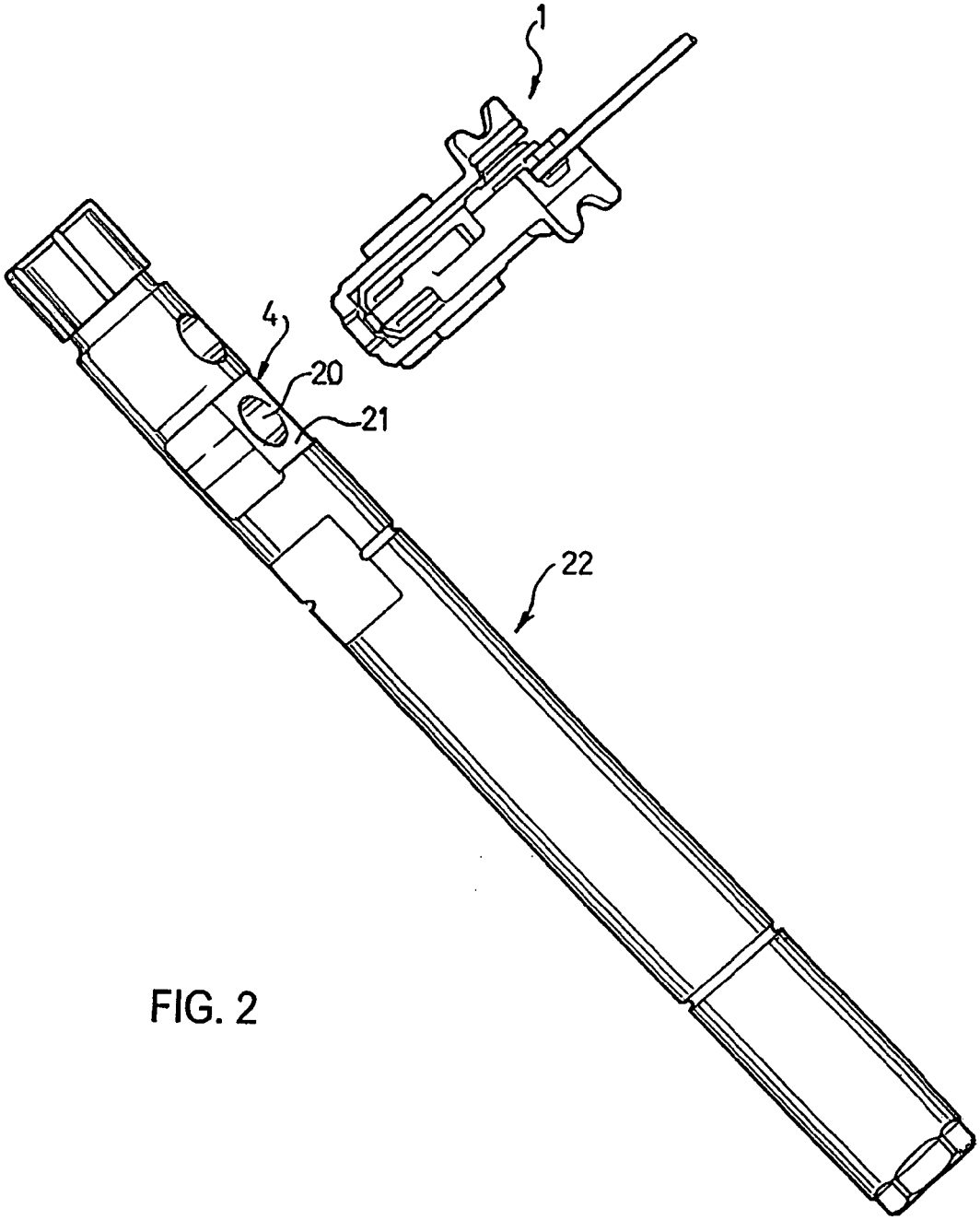

The invention will be described in detail below on the basis of the description of an embodiment example with reference to the drawing. Shown therein are:

FIG. 1: a perspective depiction of an embodiment example of a plug in accordance with the invention;

FIG. 2: a perspective view of an injection nozzle having a mating plug region and a not yet inserted plug;

FIGS. 3 to 12: the course of assembly in individual steps in lengthwise section through the plug connector arrangement in accordance with the invention.

FIG. 1 shows an embodiment example of a plug of the plug connector arrangement in accordance with the invention. The plug 1 has a housing 23 with skirts 7 molded in a unitary construction thereon and a secondary locking 3. Mounted in the housing is a contact carrier block 18, which projects into the space bounded by the skirts 7 and is sealed with respect to the plug housing 23 with a sealing ring 19. Mounted on the outer side of the skirts 7 are the first catch arms 2 in the form of a bent steel wire clip in guide grooves 24. The skirts 7 have brackets 8 at their head ends, which form an opening 25, into which the front end 26 of the second catch arms 9 of the secondary locking 3 are inserted into their final catch position. Formed, in addition, at the front region of the skirts 7, in the middle, are openings 11, through which the catch lugs 5 and 10 of the first and second catch arms 2 and 9, respectively, project into the space bounded by the skirts 7.

At the cable-side end of the plug 1, the secondary locking 3 and the housing 23 have handling surfaces 27 and 28, on which the user presses when the plug 1 is plugged into the plug region of the mating plug 4 so as to, first of all, lock the plug 1 in the mating plug 4 and, subsequently, bring the secondary locking 3 into its final catch position.

In its rear part, the plug housing 23 further has opposite-lying indentations 29, which extend into indentations 30 in the secondary locking 3 and which make freely accessible the rear end of the first catch arms 2 in the form of steel wire clips.

When the plug connection is released, the secondary locking 3 is first moved into its pre-catch position by pulling on the handhold 28. Once this has happened. the recesses 29 and 30 align, so that, now, the wire clip of the first catch arms 2 can be pressed together with two fingers. Owing to the fact that the wire clip lies on the bottom of the grooves 24, there results a "see-saw effect", so that the front part of the wire clip with the catch lugs 5 is raised out of the grooves 24. The engagement of the catch lugs behind the shoulders 6 of the mating plug 4 is thereby released and the plug 1 can be withdrawn.

FIG. 2 shows a perspective view of an injection nozzle 22 with a mating plug region 4, on which the plug 1 is inserted at an angle of 90° to the lengthwise axis of the cylindrical injection nozzle. The mating plug 4 has a recess 20, which partially accommodates the contact carrier block 18. The front edge 20 presses thereby against the sealing ring 19, so that the contacts of plug and mating plug 1, 4 are protected against moisture and dirt.

FIGS. 3 to 12 show, in chronological sequence, the course of assembly. Shown therein are the plug 1 in lengthwise section along the plug axis and the plug region of the cylindrical injection nozzle 22 in cross section. It is to be noted that the section below the lengthwise central axis of the plug 1 is drawn exactly in the plane of the lengthwise central axis, whereas the section above the lengthwise central axis is shifted somewhat parallel in relation to the former. In this way, it is made clear that the catch arm 9 of the secondary locking 3 has a cross-sectional profile that is thicker in its middle and has the catch lug 10, whereas the side flanks of the catch arm 9 are constructed thinner and catch lugs 13 are molded at the free end of the catch arm 9 and are formed in complementary depressions 14 on the outer side of the skirts 7 on the edge of the opening 11.

Figure 3:
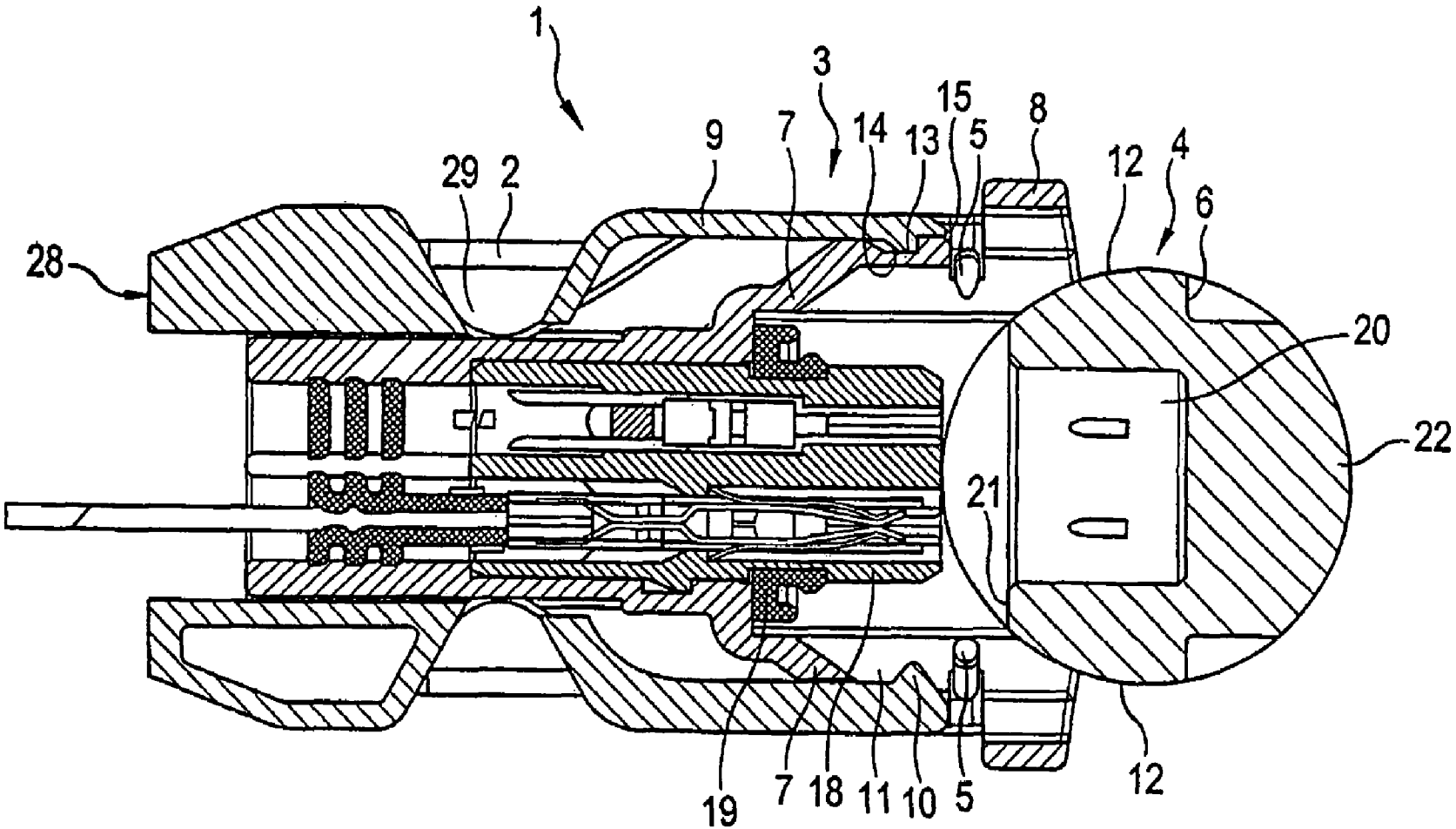

In FIG. 3, the individual parts are essentially completely furnished with reference numbers. Entered in the following FIGS. 4 to 12 are only those reference numbers that are necessary for explaining the respective stage of assembly.

In the position shown in FIG. 3, the plug 1 is not yet in contact with the mating plug 4. The secondary locking 3 is secured in the pre-catch position via the just explained catch lugs 13 or catch grooves 14. Both the catch lug 5 of the first catch arm 2 and the catch lug 10 of the catch arm 9 of the secondary locking 3 project into the space bounded by the skirts 7 through openings 11 in the skirts 7.

Figure 4:
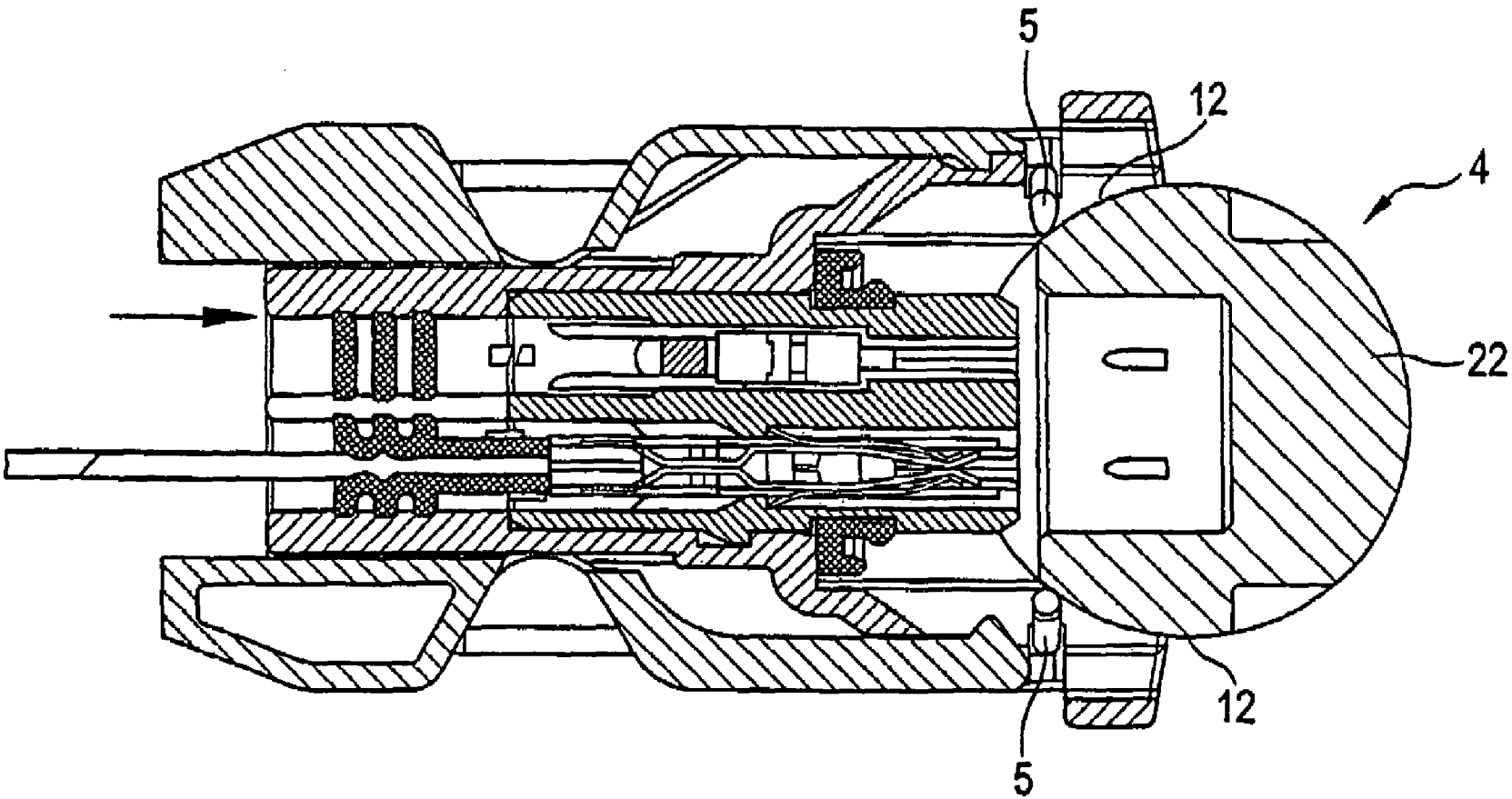

In the stage shown in FIG. 4, the catch lugs 5 just touch the mating plug 4 on the body of the injection nozzle 22.

Figure 5:
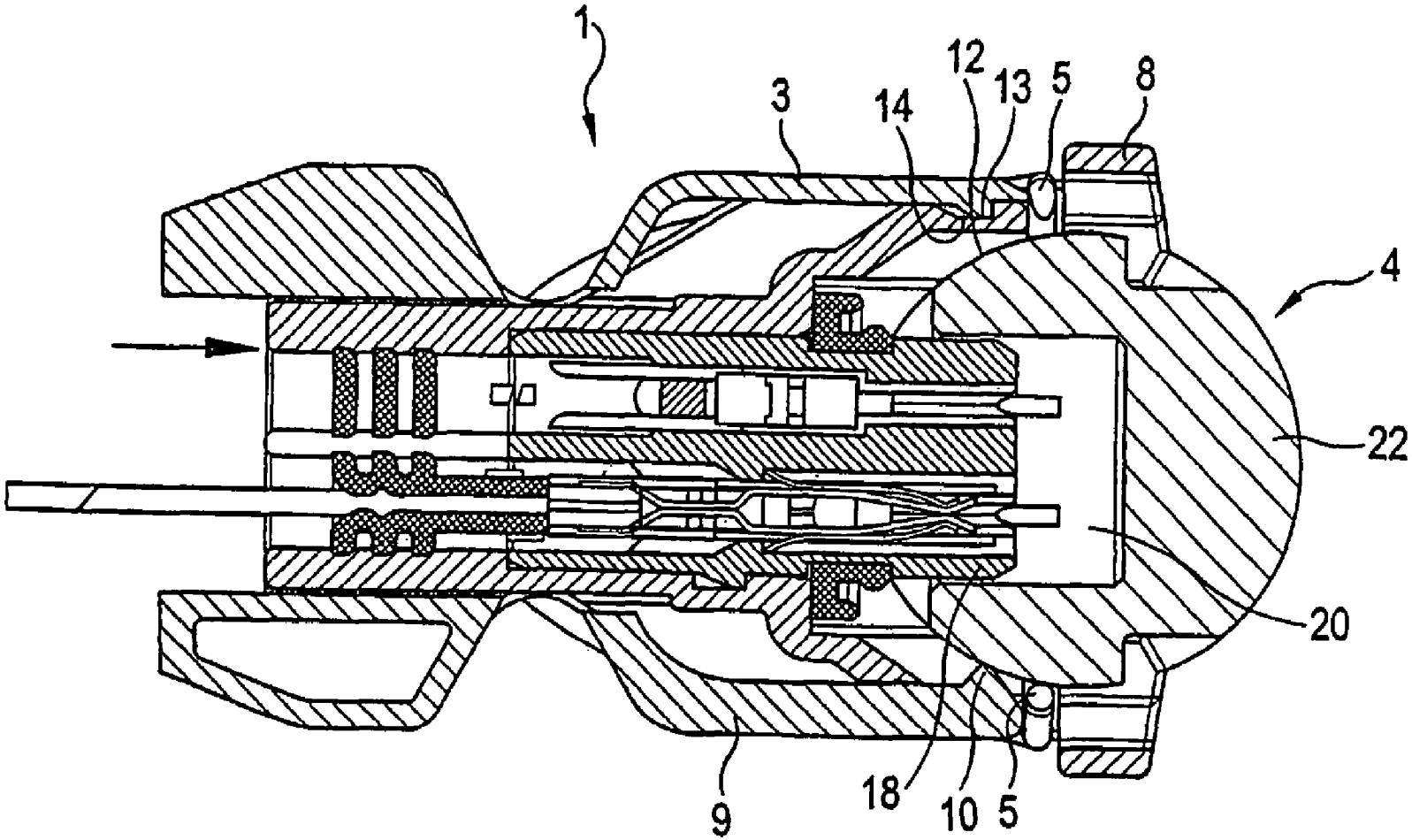

In the position shown in FIG. 5, the contact carrier block 18 is already partially inserted into the recess 20 of the mating plug 4 in the injection nozzle 22. The catch lugs 5 have been pushed away from the lengthwise central axis of the plug 1 by sliding on the ramps 12. In this stage, the catch lugs 5 lie exactly in front of the opening of the bracket 8 and block it from access to the free ends of the secondary locking 3. In this position, the catch 10 of the second catch arm 9 of the secondary locking 3 just touches the ramp 12, but the catch arm 9 is not yet displaced with respect to its rest position. Accordingly, the secondary locking 3 is still locked via the catch means 13, 14 in the pre-catch position.

Figure 6:
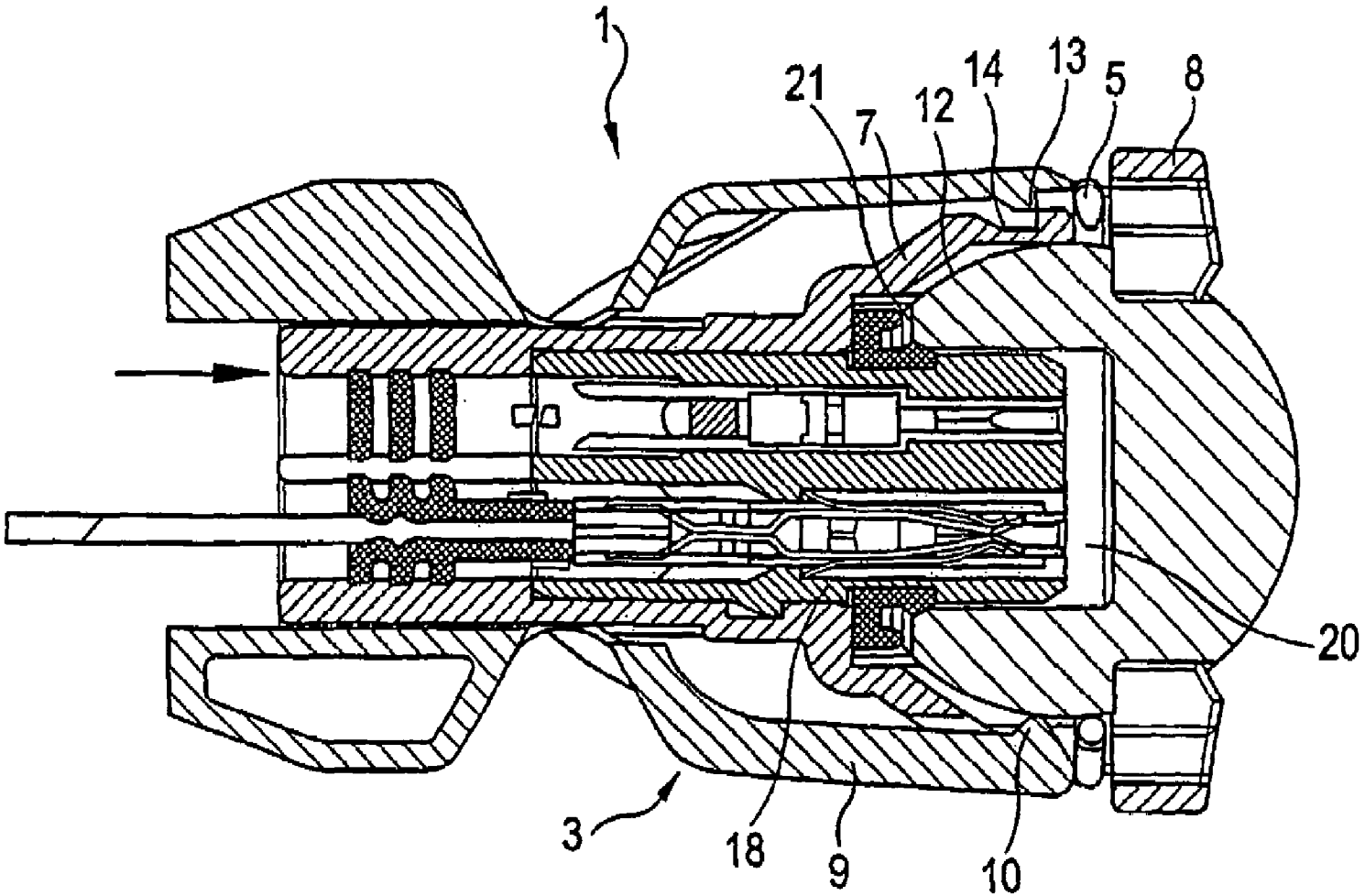
Figure 7:
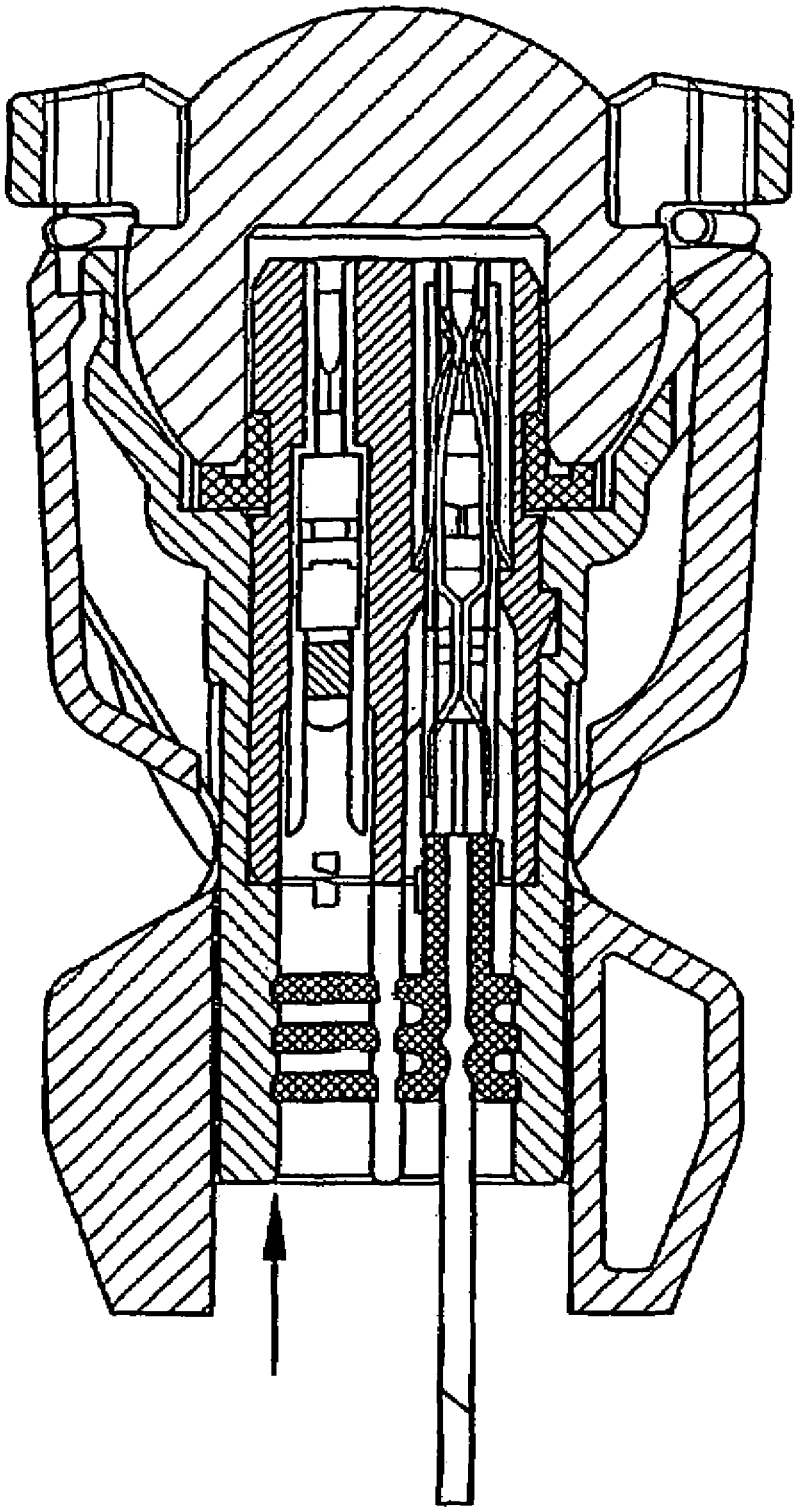
Figure 8:
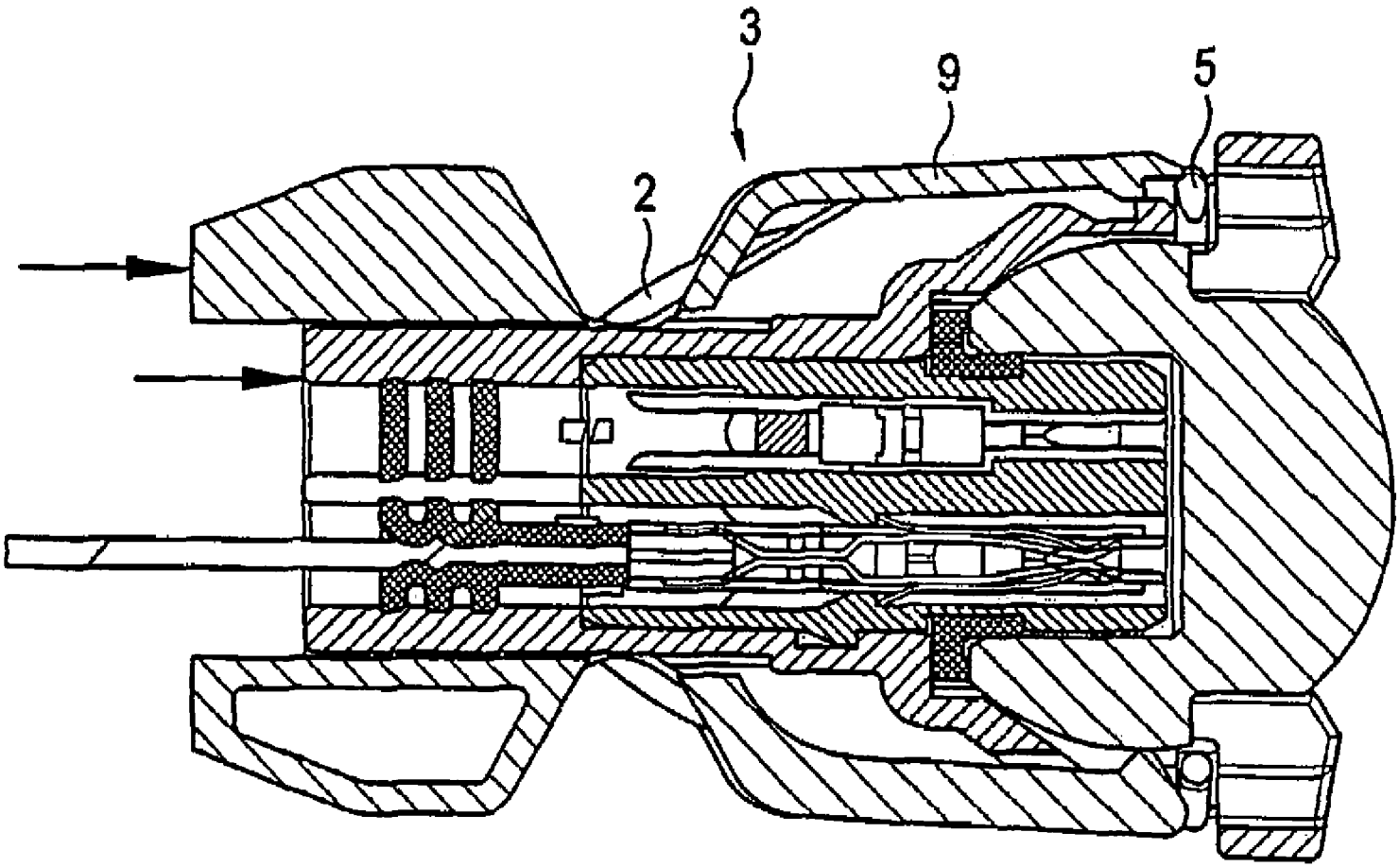

In the stage shown in FIG. 6, this is no longer the case; that is, the second catch arms 9 of the secondary locking 3 are pulled apart by the sliding of the catch lugs 10 on the ramps 12, that is, pressed away from the lengthwise central axis of the plug 1, so that the catch lug 13 of the catch arm 9 is raised out of the catch groove 14 on the outer side of the skirt 7. Accordingly, the catch lug and the catch groove 13, 14 are no longer engaged and the secondary locking 3 can be shifted into the plug-in direction. The catch lug 5 of the first catch arm 2 continues to block the access of the bracket 8. Furthermore, the contact carrier block 18 has penetrated so far into the recess 20 that the front edge 21 of the recess 20 is in contact with the sealing ring 19 and a sealing of the space in which the contact is situated begins.

FIGS. 7 and 8 again show in detail the release of the secondary locking 3 from its pre-catch position and the abutment of the tips of the second catch arms 9 against the U-shaped bent catch lugs 5 of the first catch arms 2.

Figure 9:
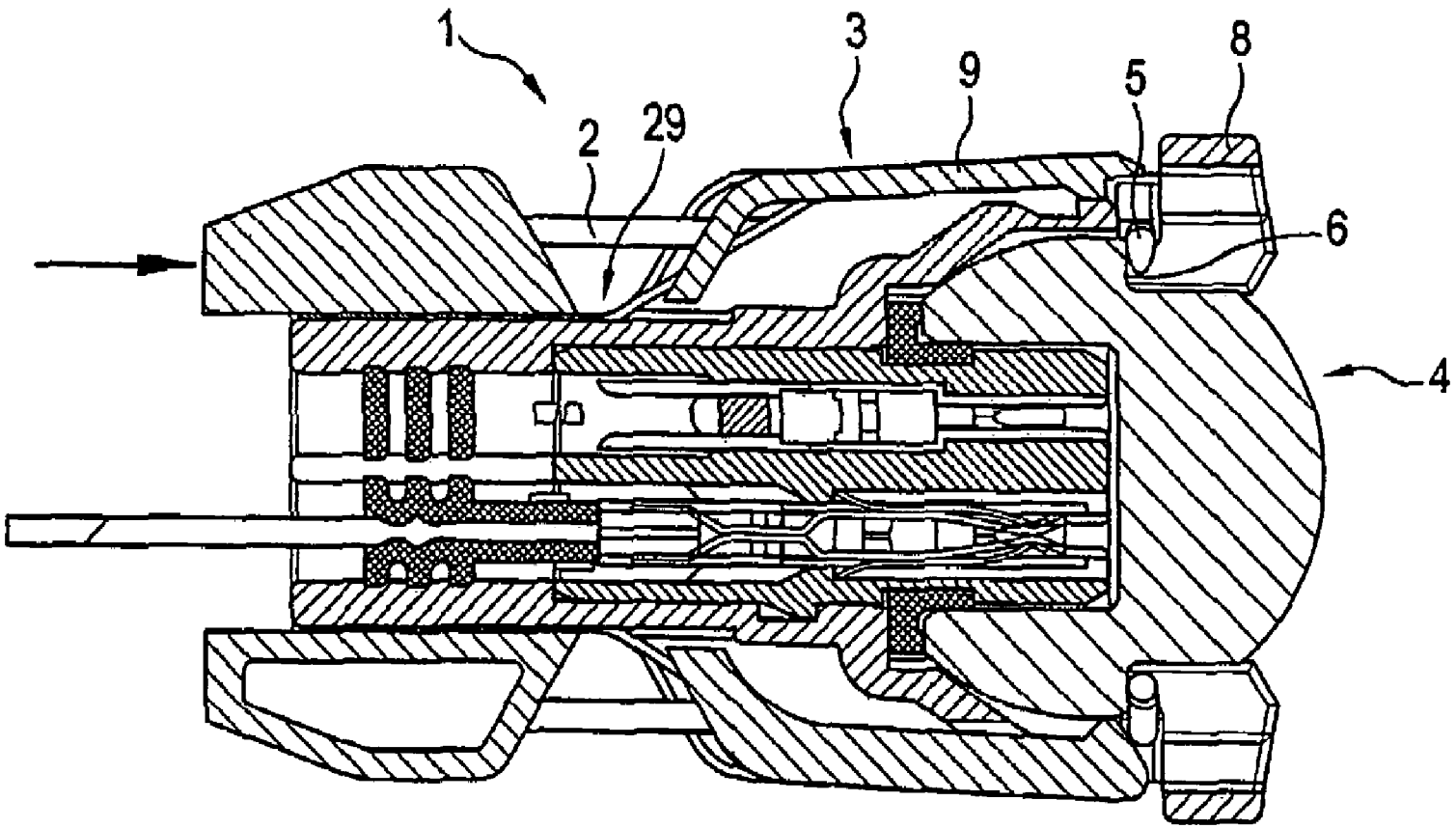
Figure 10:
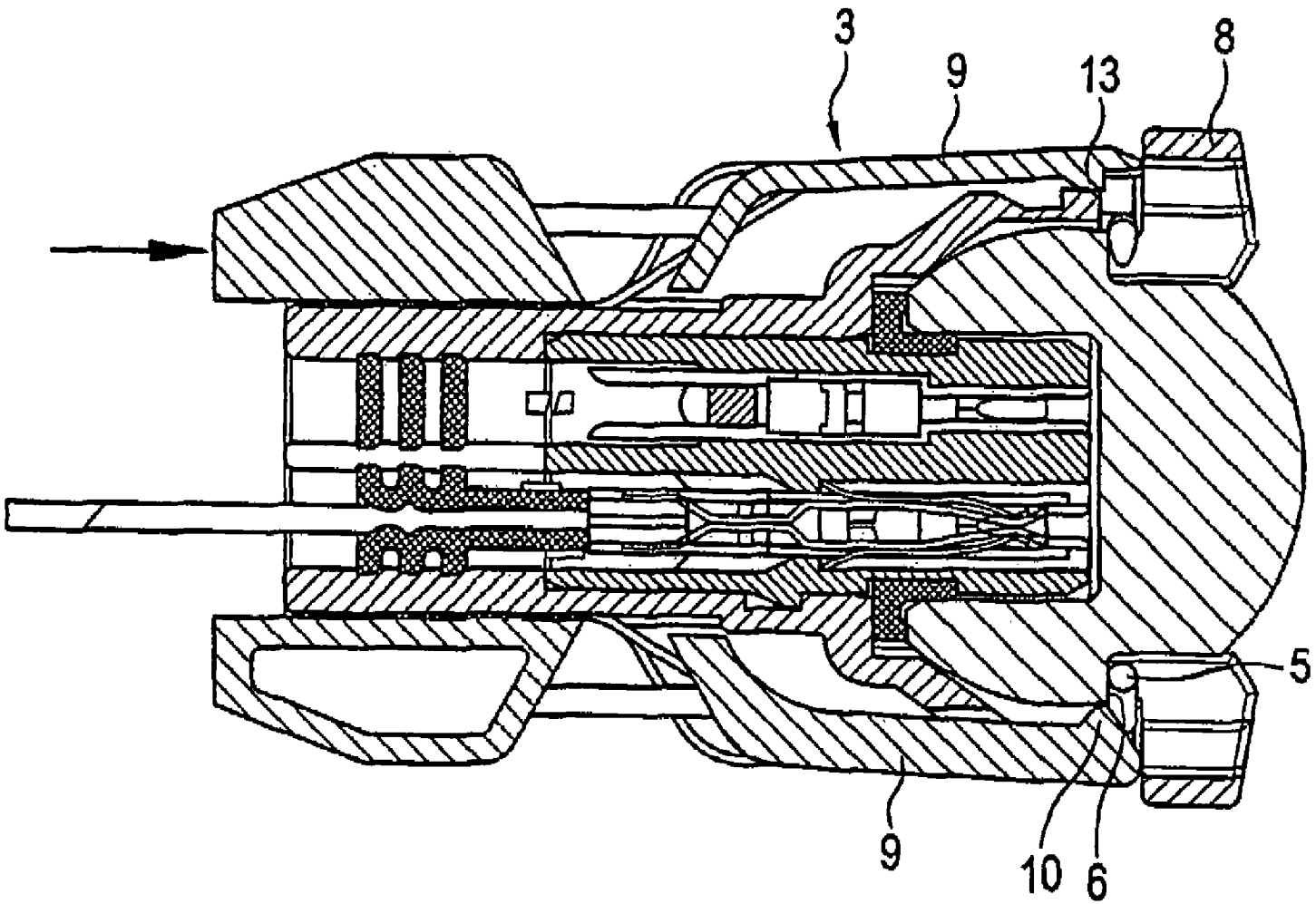
Figure 11:
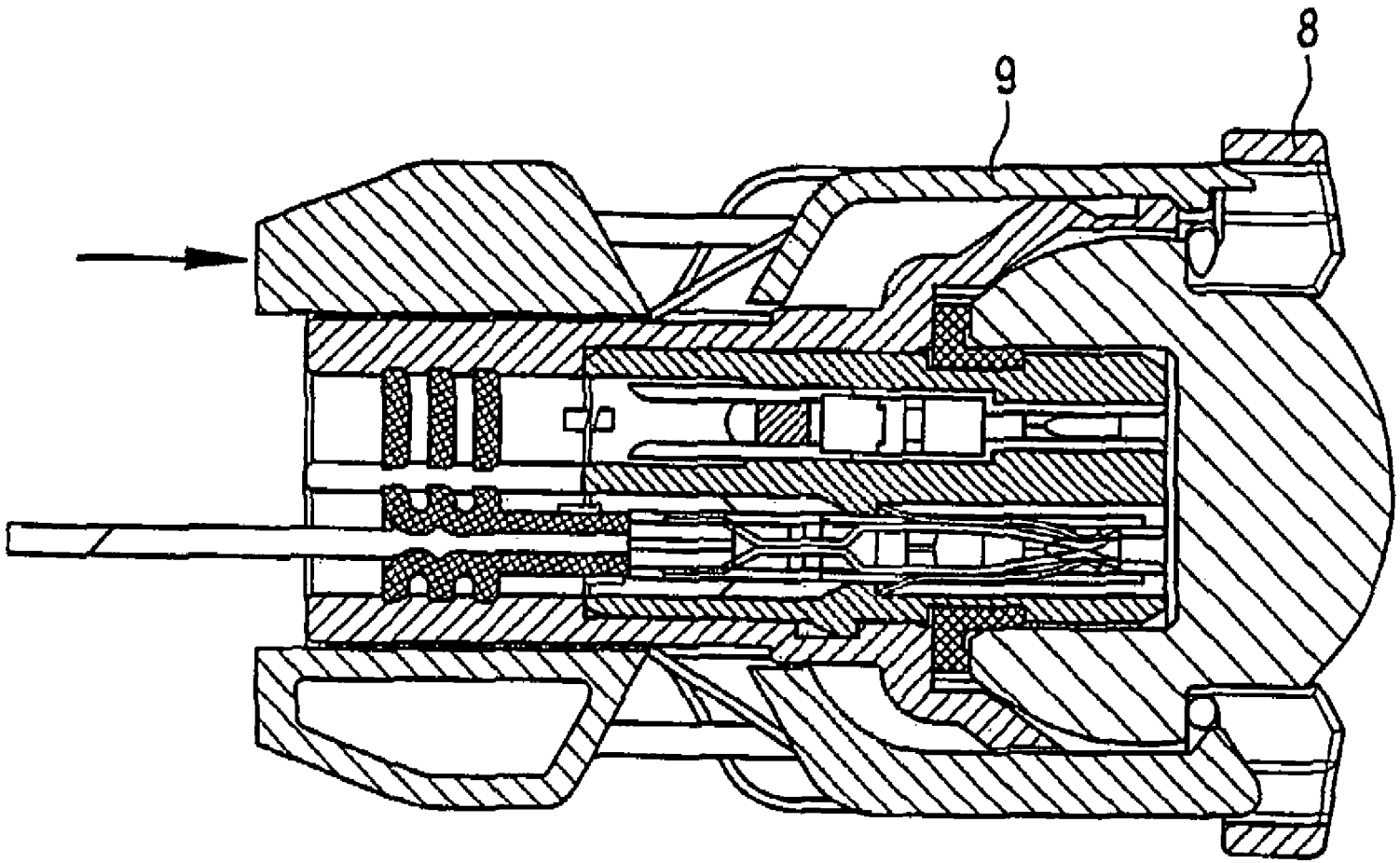
Figure 12:
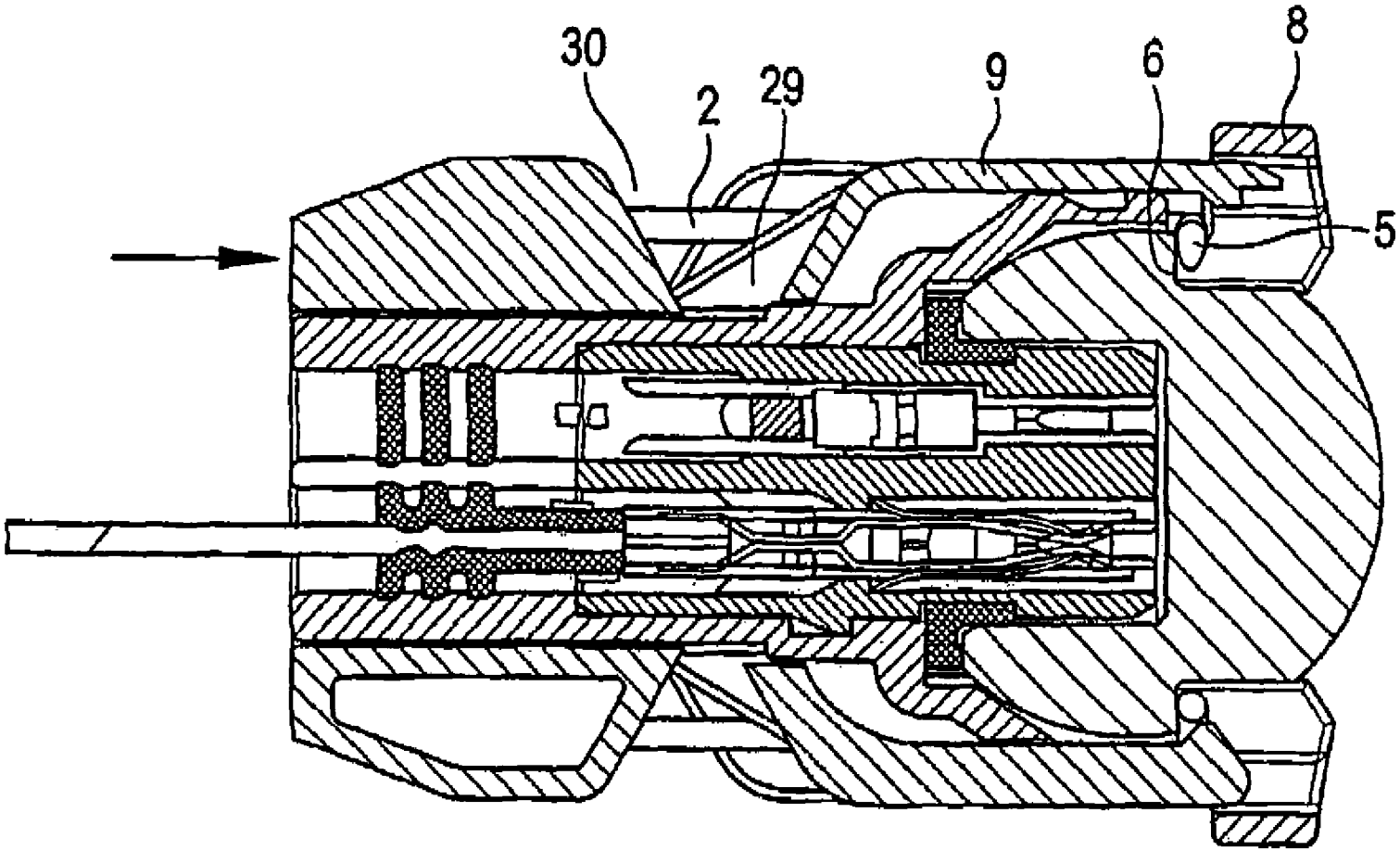

In FIG. 9, the catch lug 5 has now sprung behind the shoulder 6 in the mating plug 4, whereby the plug connection is locked between the plug 1 and the mating plug 4. It is further evident that the first catch arm 2, made of steel wire, is now again released from tension and the wire clip appears again in the recess 29 (which was not the case in the stages of FIGS. 5 to 8). At the same time, the access to the opening in the bracket 8 is now free, so that the second catch arm 9 of the secondary locking 3, released from its pre-catch position, can now penetrate with its front ends into the bracket 8. This is shown in FIGS. 10 to 12, wherein FIG. 10 shows the catch lugs 10 and 13 of the second catch arms 9 sliding beneath the upper edge of the shoulder 6. In the upper edge region of the tips of the second catch arms 9, they are somewhat angled in order to facilitate their insertion into the opening of the bracket 8.

FIG. 11 shows the further penetration of the second catch arms 9 into the opening of the bracket 8 and FIG. 12 shows the plugged-together plug connector arrangement in its final catch position. It is evident that the catch lug 5 of the first catch arm 2 can no longer be moved out of its locking behind the shoulder 6, because the path from the lengthwise central axis of the plug 1 is blocked radially outwards by the second catch arm 9, secured by the bracket 8.

It is further evident in FIG. 12 that the depression 29 is not flushly aligned with the depression 30 (see FIG. 1) of the secondary locking, so that it is difficult to press down the wire clip of the first catch arms 2 with the fingers.

The release of the plug connection begins with the pulling of the secondary locking 3 out of its final catch position into its pre-catch position. The depressions 29 and 30 are then flushly aligned and the wire clip of the first catch arms 2 is accessible for access with two fingers.

The wire clip is then pressed, so that the catch lugs 5 are released from their locking behind the shoulder 6 and are positioned above the ramp 12. A pulling of the plug 1 out of the mating plug 4 can now ensue.

The above-described example of an embodiment of the invention claimed in the claims is not to be understood as limiting, but serves merely for purposes of illustration. Thus, for example, the shape of the ramps 12 is not necessarily curved, as for the cylindrical jacket surface of an injection nozzle, but rather can have other suitable shapes, such as, for example, that of a linear ramp. The first catch arm need not involve a wire clip; also conceivable is the use of plastic catch arms. The form of the plug housing in the embodiment example shown was chosen from practical considerations, because it has advantages in injection molding. Any other useful form is conceivable, whereby, customer-specific wishes, which ensue from a specific form of a mating plug, can be taken into consideration without anything further.

For plugging in, corresponding to a first conventional procedure, the user first presses on the handling surface 27 in order to lock the plug 1 in the mating plug 4 and subsequently presses on the handling surface 28 in order to bring the secondary locking 3 into its final catch position. However, a further advantage of the invention consists in the fact that it is also possible to accomplish the plugging with one motion in that it is sufficient to press on the handling surface 28 in order to shift the secondary locking 3, first together with the locked-together housing 23, until the latter locks in the fully plugged-in state, and subsequently alone to the final catch position.

The invention claimed is:

1. A plug connector arrangement comprising:

a plug, having first catch arms arranged parallel to a plug-in direction and a secondary locking, and a mating plug with shoulders, behind which catch lugs of the first catch arms engage in a final plugged-in position, characterized in that the secondary locking is released from a pre-catch position by the mating plug during a plugging-in process and, on reaching a final catch position, is held back by the first catch arms until the catch lugs thereof are locked behind the shoulders of the mating plug, wherein, around a plug face of the plug, the plug has a skirt, on the front end of which are molded brackets, which, in the final catch position, secure the front ends of second catch arms of the secondary locking, accommodated therein, against radially outwardly acting forces.

2. The plug connector arrangement according to claim 1, further characterized in that the first catch arms are arranged outside of the skirt and their catch lugs project so far through openings in the skirt into the region in front of the plug face of the plug that, when the mating plug is inserted, they come into contact with it.

3. The plug connector arrangement according to claim 1, further characterized in that the second catch arms of the secondary locking are arranged outside of the skirt and their catch lugs project so far through openings in the skirt into the region in front of the plug face of the plug that, when the mating plug is inserted, they come into contact with it.

4. The plug connector arrangement according to claim 3, further characterized in that the mating plug has ramps, on which the catch lugs of the first catch arms and the catch lugs of the second catch arms of the secondary locking slide during the plug-in operation and are moved away from the central lengthwise axis of the plug.

5. The plug connector arrangement according to claim 4, further characterized in that the ramps end with the shoulders, behind which the catch lugs of the first catch arms are locked in final catch position.

6. The plug connector according to claim 4, further characterized in that the second catch arms of the secondary locking have catch means on the side facing the skirt for locking of the secondary locking in a pre-catch position, in which they engage in complementary catch means on the outer side of the skirt, and in that, when the mating plug is inserted, the ramps thereof displace the catch lugs of the second catch arms so far from the lengthwise central axis that the catch means, mutually engaged in the pre-catch position, are brought out of engagement, whereby the secondary locking is released from its pre-catch position.

7. The plug connector arrangement according to claim 6, further characterized in that the first catch arms, prior to attaining their final catch position, block the second catch arms, so that the latter cannot attain their final catch position.

8. The plug connector arrangement according to claim 6, further characterized in that the free ends of the second catch arms abut against the catch lugs thereof during the plug-in process prior to reaching the final catch position of the first catch arms.

9. The plug connector arrangement according to claim 1, further characterized in that the first catch arms and the catch lugs thereof consist of bent wire clips.

10. The plug connector arrangement according to claim 9, further characterized in that the catch lugs of the first catch arms are molded as U-shaped loops that project into the openings of the skirt.

11. The plug connector arrangement according to claim 1, further characterized in that the skirt has opposite-lying recesses adjacent to the regions in which the first and second catch arms are arranged.

12. The plug connector arrangement according to claim 11, further characterized in that the plug has a housing made of plastic, to which is adjoined the skirt in a unitary construction and in which a contact carrier block is mounted, the front side of which projects into the space bounded by the skirt, whereby a sealing ring seals the gap between the contact carrier block and the housing.

13. The plug connector arrangement according to claim 12, further characterized in that the mating plug has a plug-in region, in an essentially cylindrical body, the cylinder axis of which is oriented at an angle of 90° to the plug axis, with a recess complementary to the contact carrier block of the plug, in which are arranged contacts complementary to the contacts of the plug.

14. The plug connector arrangement according to claim 13, further characterized in that the front edge of the socket is flat and, in the plugged-in state, presses on the sealing ring in the plug.

15. The plug connector arrangement according to claim 13, further characterized in that the mating plug has ramps, on which the catch lugs of the first catch arms and the catch lugs of the second catch arms of the secondary locking slide during the plug-in operation and are moved away from the central lengthwise axis of the plug, and further characterized in that the ramps are formed by means of the cylindrical jacket parts on both sides of the recess of the mating plug.

16. The plug connector arrangement according to claim 13, further characterized in that, around its plug face, the plug has a skirt, on the front end of which are molded brackets, which, in the final catch position, secure the front ends of the second catch arms of the secondary locking, accommodated therein, against radially outwardly acting forces, and further characterized in that the cylindrical body is bounded over more than three-fourths of its diameter by the skirt and edges of the recesses in the skirt follow essentially the shape of the cylindrical jacket so as to terminate the plug-in region.

17. The plug connector arrangement according to claim 13, further characterized in that the mating plug region is arranged on the cylindrical body of a diesel injection nozzle.

18. A plug connector arrangement comprising:

a plug comprising first catch arms arranged parallel to a plug-in direction and a secondary locking, wherein the first catch arms comprise catch lugs, and wherein the secondary locking comprises second catch arms, and a mating plug with shoulders, behind which the catch lugs engage in a final plugged-in position, wherein the secondary locking is adapted to be released from a pre-catch position by the mating plug during a plugging-in process and, on reaching a final catch position with the mating plug, is adapted to be held back by the first catch arms until the catch lugs are locked behind the shoulders of the mating plug, wherein, a skirt is provided at a plug face of the plug, wherein a front end of the skirt comprises molded brackets, which, in the final catch position, are adapted to secure the front ends of second catch arms of the secondary locking, accommodated therein, against radially outwardly acting forces.

* * * * *